US007717722B2

(12) United States Patent
Tomitaku et al.

(10) Patent No.: US 7,717,722 B2
(45) Date of Patent: May 18, 2010

(54) CABLE TERMINAL AND CABLE USING THE SAME

(75) Inventors: Eiji Tomitaku, Kawagoe (JP); Takayoshi Shimazaki, Kawagoe (JP); Syouta Takeshima, Kawagoe (JP)

(73) Assignee: Husqvarna Zenoah Co., Ltd., Kawagoe-shi (JP)

( * ) Notice: Subject to any disclaimer, the term of this patent is extended or adjusted under 35 U.S.C. 154(b) by 0 days.

(21) Appl. No.: 12/301,152

(22) PCT Filed: May 17, 2007

(86) PCT No.: PCT/JP2007/060139

§ 371 (c)(1),
(2), (4) Date: Nov. 17, 2008

(87) PCT Pub. No.: WO2007/135951

PCT Pub. Date: Nov. 29, 2007

(65) Prior Publication Data

US 2009/0191734 A1 Jul. 30, 2009

(30) Foreign Application Priority Data

May 18, 2006 (JP) ..... 2006-139089

(51) Int. Cl.
*H01R 13/44* (2006.01)

(52) U.S. Cl. ..... 439/125; 439/948

(58) Field of Classification Search ..... 439/125, 439/881, 948; 174/152
See application file for complete search history.

(56) References Cited

U.S. PATENT DOCUMENTS 4,514,712 A * 4/1985 McDougal ..... 336/96

(Continued)

FOREIGN PATENT DOCUMENTS

JP 56-69885 A 6/1981

(Continued)

OTHER PUBLICATIONS

International Preliminary Report on Patentability and Written Opinion of the International Searching Authority, dated Dec. 10, 2008, issued in connection with International Application Serial No. PCT/JP2007/060139 (4 pages).

(Continued)

*Primary Examiner*—Michael C Zarroli
(74) *Attorney, Agent, or Firm*—Frishauf, Holtz, Goodman & Chick, P.C.

(57) ABSTRACT

A cable terminal includes: a crimped portion crimped to a cable body; an extending piece provided integrally with the crimped portion to extend forward in an insertion direction; and a conductor conducting piece provided integrally with the crimped portion to face an end face of the cable body. An end of the extending piece abuts on an inner surface of a plug cap made of an elastic body to determine a position in terms of the insertion direction. The extending piece is provided with a springy press piece that projects to a plug terminal of an ignition plug inserted into the plug cap and contacts an end face of the plug terminal. The conductor contacting piece is sandwiched between a portion of an outer circumference of the plug terminal and a core exposed from the end face of the cable body. The plug terminal is disposed to be in tight contact with the inner surface of the plug cap.

3 Claims, 6 Drawing Sheets

U.S. PATENT DOCUMENTS

| | | | | |
|---|---|---|---|---|
| 4,886,473 | A | 12/1989 | Germ | |
| 5,026,294 | A * | 6/1991 | Hisatomi et al. | 439/125 |
| 5,593,308 | A * | 1/1997 | Kobayashi | 439/125 |
| 5,716,223 | A * | 2/1998 | Phillips et al. | 439/125 |
| 5,785,560 | A * | 7/1998 | Akamatsu | 439/851 |
| 6,048,217 | A | 4/2000 | Kobayashi | |
| 6,467,447 | B1 * | 10/2002 | Holmes et al. | 123/169 PA |
| 6,635,605 | B1 * | 10/2003 | Como et al. | 508/183 |
| 7,318,339 | B2 * | 1/2008 | Nishio et al. | 73/31.05 |

FOREIGN PATENT DOCUMENTS

| | | | |
|---|---|---|---|
| JP | 02-236983 | A | 9/1990 |
| JP | 04-8772 | U | 1/1992 |
| JP | 10-144377 | A | 5/1998 |
| JP | 2001-313147 | A | 11/2001 |

OTHER PUBLICATIONS

English Language International Search Report dated Aug. 21, 2007 issued in parent Appln. No. PCT/JP2007/060139.

* cited by examiner

CABLE TERMINAL AND CABLE USING THE SAME

This application is a U.S. National Phase Application under 35 USC 371 of International Application PCT/JP2007/060139 filed May 17, 2007.

TECHNICAL FIELD

The present invention relates to a cable terminal and to a cable using the same, and particularly relates to a terminal used for a tension cable for applying high voltage on an ignition plug and to the tension cable.

BACKGROUND ART

A typical tension cable (also called as a high-tension cord) mounted on an internal combustion engine (e.g., an engine) is attached with a metallic cable terminal by a method such as crimping, in order to establish conduction between the cable and a plug terminal of an ignition plug.

A known exemplary arrangement of such a cable terminal includes: a pair of gripping portions for radially gripping an end of a cable body from both sides; an insertion portion curved to be substantially annular, the pair of gripping portions being respectively provided on ends of the insertion portion; and an acicular portion provided integrally with the insertion portion and the gripping portions (Patent Document 1).

When such a cable terminal is used, the cable terminal is brought into conduction with a core inside the cable body by thrusting the acicular portion into the cable body from an end face of the cable body, and the entirety of the cable terminal is crimped to the cable body by making the gripping portions partially cut in a coating provided on an outer circumference of the cable body with the acicular portion being thrust into the cable body. Then, by inserting the cable terminal into a plug cap while the plug cap covers a plug terminal, an end of the plug terminal is inserted into the insertion portion of the cable terminal, such that an inner surface of the insertion portion partially contacts a contact provided on an outer circumference of the plug terminal, thereby establishing conduction between the cable terminal and the plug terminal.

Patent Document 1: JP-A-2001-313147

DISCLOSURE OF THE INVENTION

Problems to Be Solved by the Invention

However, according to the arrangement of the cable terminal disclosed in the patent document 1, since the inner surface of the insertion portion merely contacts the contact provided on the outer circumference of the plug terminal, the contact of the plug terminal and the insertion portion of the cable terminal may be misaligned in terms of an insertion direction. When such a misalignment arises, the insertion portion may be located on a constricted portion provided contiguous to the contact, and favorable conduction cannot be established.

In order to prevent such a misalignment in terms of the insertion direction, JP-UM-A-4-8772 discloses that a connector spring is provided on the cable terminal, and that the connector spring is locked to the constricted portion of the plug terminal.

However, such a connector spring may not be usable, depending on a shape of the constricted portion of the plug terminal. Specifically, in an arrangement where the constricted portion is so deeply concaved that substantially no taper face is formed thereon, the connector spring having been locked thereto may not be disengaged from the constricted portion. Thus, for instance, at the time of an inspection of the ignition plug, the plug cap may not be easily detached from the plug terminal.

In addition, according to the arrangement of the cable terminal disclosed in the patent document 1, since the acicular portion is thrust into the cable body from its end face to be in conduction with the core, an insertion direction of the acicular portion may be deviated at the time when the cable terminal is mounted. When such a deviation arises, a sufficient contact may not be established between the acicular portion and the core, thereby entailing an instable conduction.

An object of the invention is to provide a cable terminal capable of reliably establishing conduction with a cable body and an ignition plug and enhancing workability, and to provide a cable using the same.

Means for Solving the Problems

A cable terminal according to an aspect of the invention is a cable terminal inserted into a plug cap for an ignition plug while being crimped to a cable body, the cable terminal including: a crimped portion crimped to the cable body; an extending piece provided integrally with the crimped portion to extend forward in an insertion direction; and a conductor contacting piece provided integrally with the crimped portion to face an end face of the cable body, in which an end of the extending piece abuts on an inner surface of the plug cap to determine a position in terms of the insertion direction, the plug cap being made of an elastic body, the extending piece is provided with a springy press piece that projects to a plug terminal of the ignition plug inserted into the plug cap and contacts an end face of the plug terminal, and the conductor contacting piece is sandwiched between a portion of an outer circumference of the plug terminal and a core exposed from the end face of the cable body, the plug terminal disposed to be in tight contact with the inner surface of the plug cap.

A cable according to another aspect of the invention includes: the above-described cable terminal; the cable body to which the cable terminal is crimped; and the plug cap into which the cable terminal having been crimped to the cable body and the ignition plug are inserted, the cable terminal being inserted from a first end side of the plug cap, the ignition plug being inserted from a second end side of the plug cap.

According to the aspect(s) of the invention, since the cable terminal includes the press piece and the conductor contacting piece, the cable terminal can contact the plug terminal in two directions perpendicular to each other, thereby favorably preventing a deviation of the insertion direction of the plug terminal. At this time, since the position of the extending piece is determined within the plug cap, a pressing force can be sufficiently applied on the end face of the plug terminal. In addition, since the conductor contacting piece is sandwiched between the outer circumference of the plug terminal and the core while being pressed by the plug terminal having been disposed within the plug cap made of an elastic body, contact between the plug terminal and the cable terminal can be favorably maintained, and reliable conduction can be established therebetween as compared with a conventional arrangement in which an acicular portion is used. Further, since no connector spring is used in order to obtain reliable conduction unlike a conventional arrangement, the plug cap can be easily attached to and detached from the ignition plug even when the ignition plug has a large constricted portion, thereby enhancing workability.

Preferably in the cable according to the aspect of the invention, a plug-insertion hole of the plug cap is provided with a projection that inwardly projects, and the projection is fitted into a recess provided adjacent to the plug terminal of the ignition plug in a concave-convex manner.

According to the aspect of the invention, since the concave-convex fitting portion is provided adjacent to the plug terminal, the position of the plug terminal can be further stabilized. Thus, conduction between the plug terminal and the cable terminal can be favorably maintained, thereby contributing to enhanced reliability.

BEST MODE FOR CARRYING OUT THE INVENTION

An exemplary embodiment of the invention will be described below with reference to the attached drawings.

Figure 1:
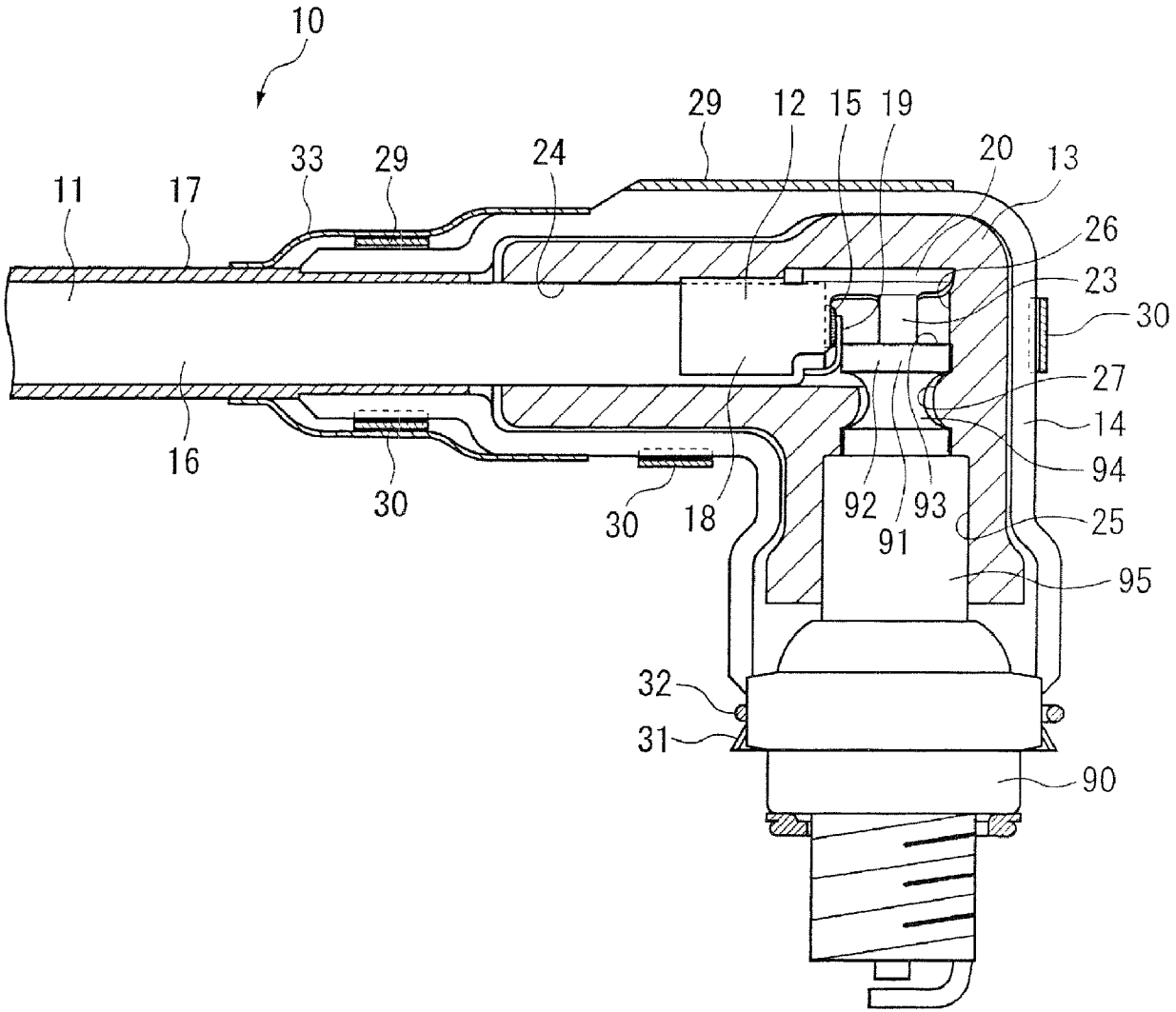
FIG. 1 is a cross-sectional view showing a primary portion of a cable according to an exemplary embodiment of the invention.
Figure 2:
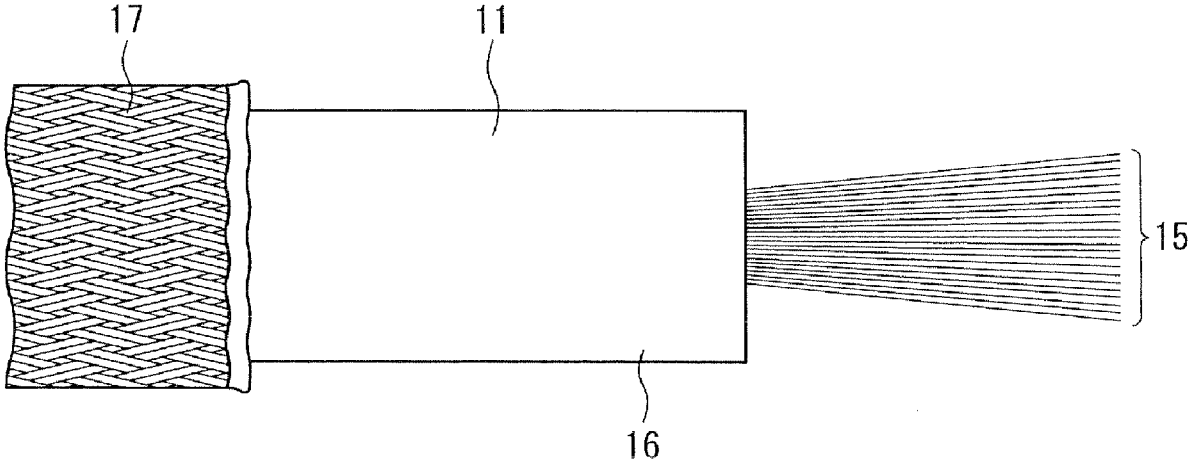
FIG. 2 is a lateral view showing an end of a cable body having been stripped.
Figure 3:
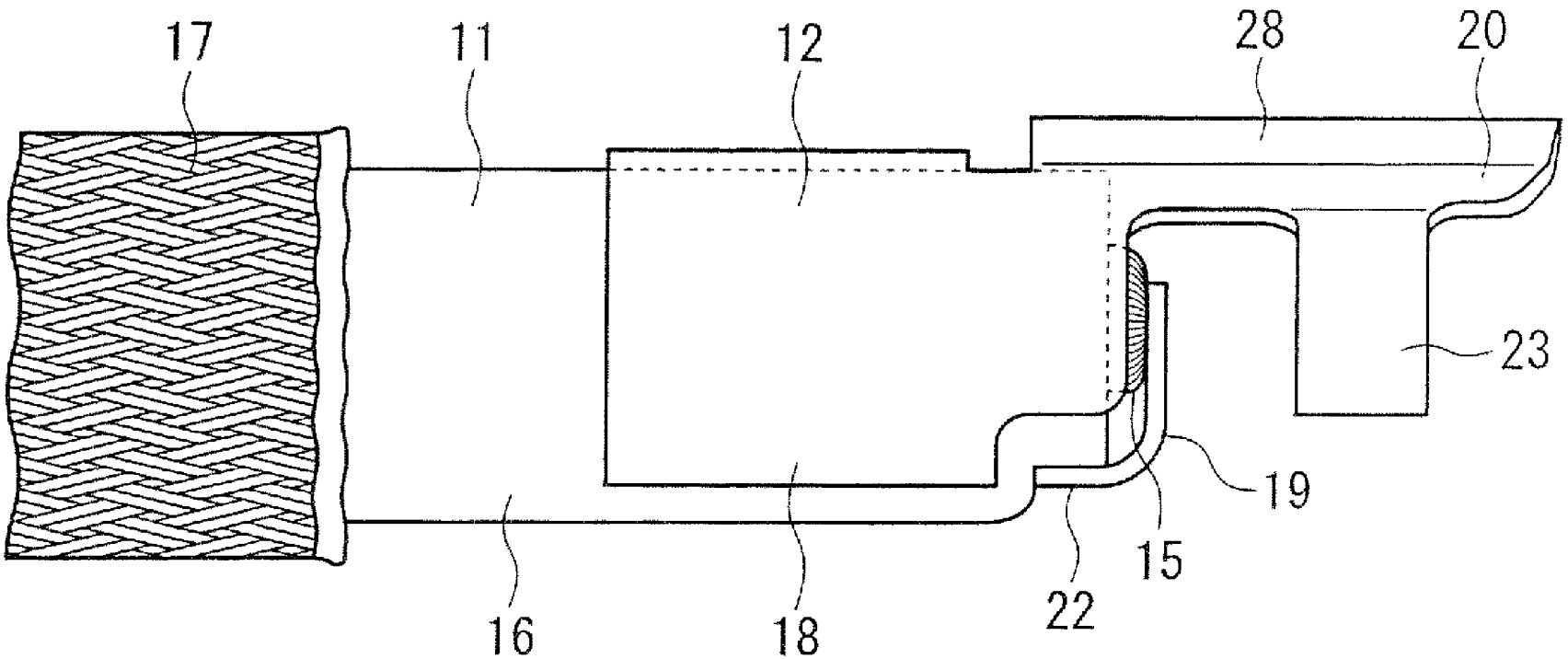
FIG. 3 is a lateral view showing the end of the cable body having been crimped with a cable terminal.
Figure 4:
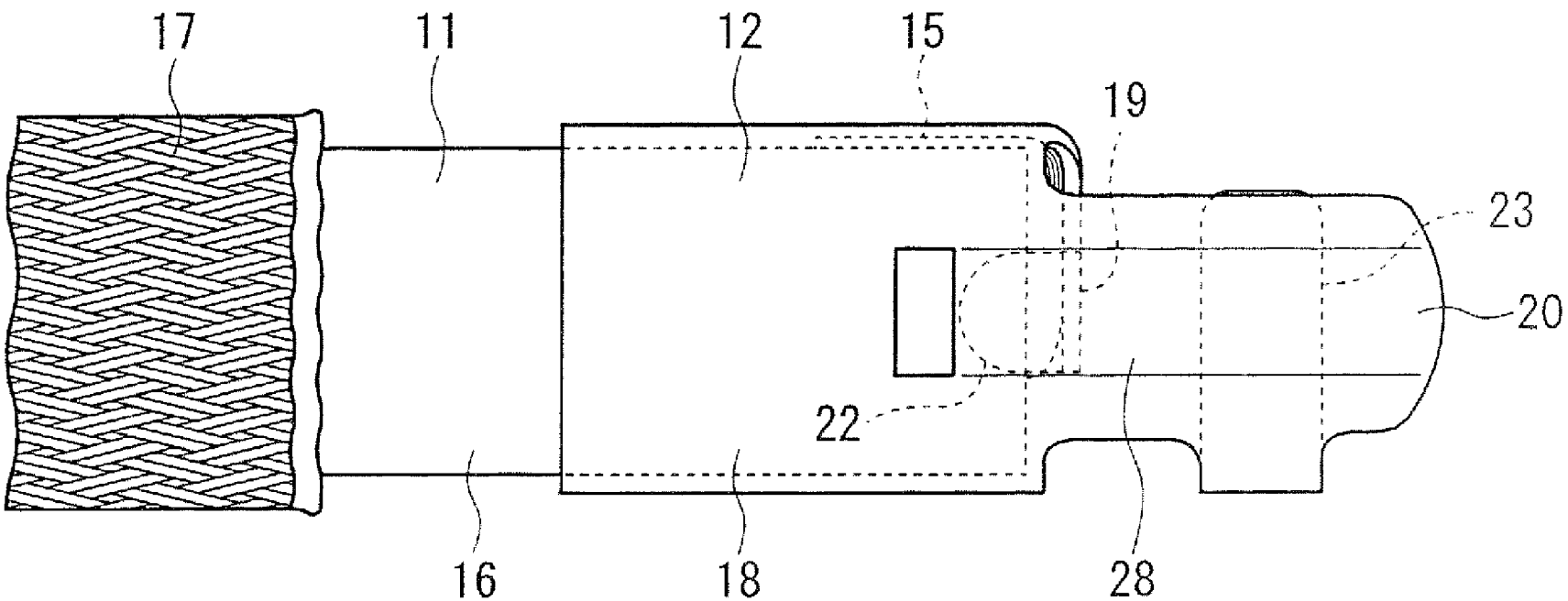
FIG. 4 is a top view showing the end of the cable body in FIG. 3.
Figure 5:
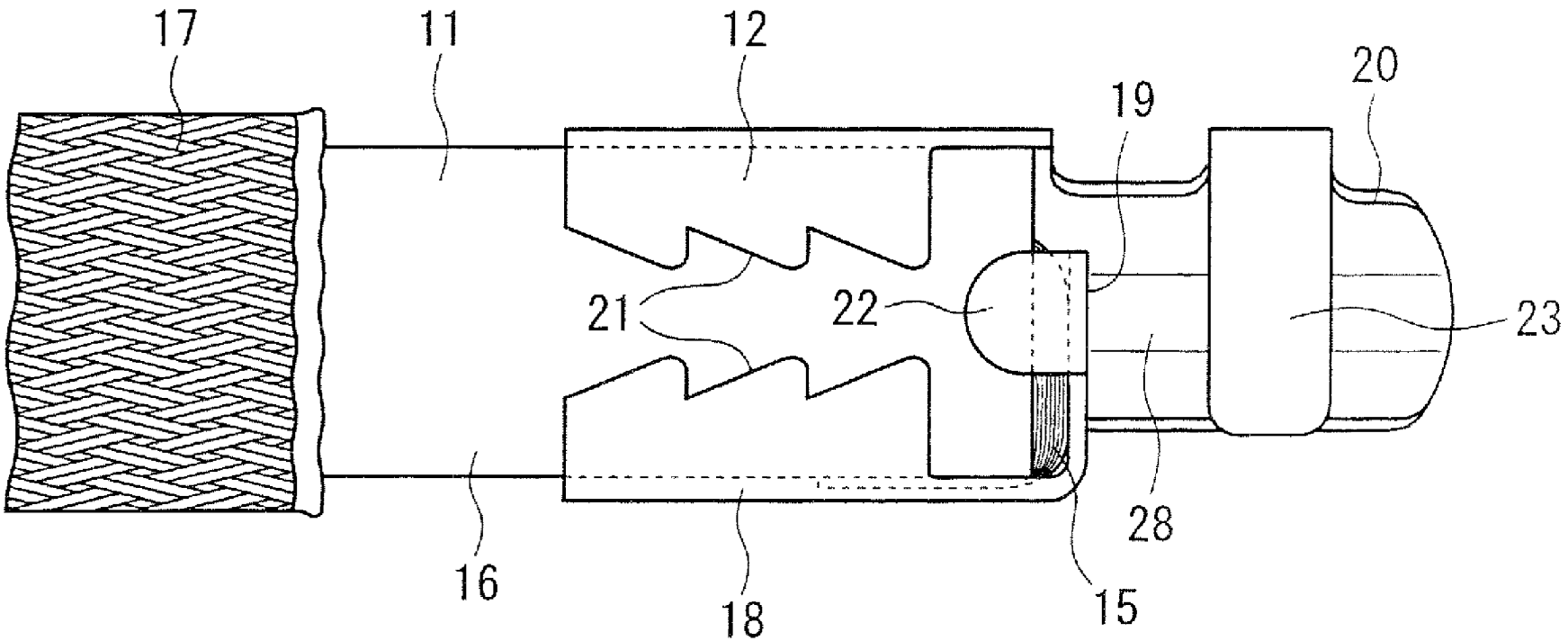
FIG. 5 is a bottom view showing the end of the cable body in FIG. 3.
Figure 6:
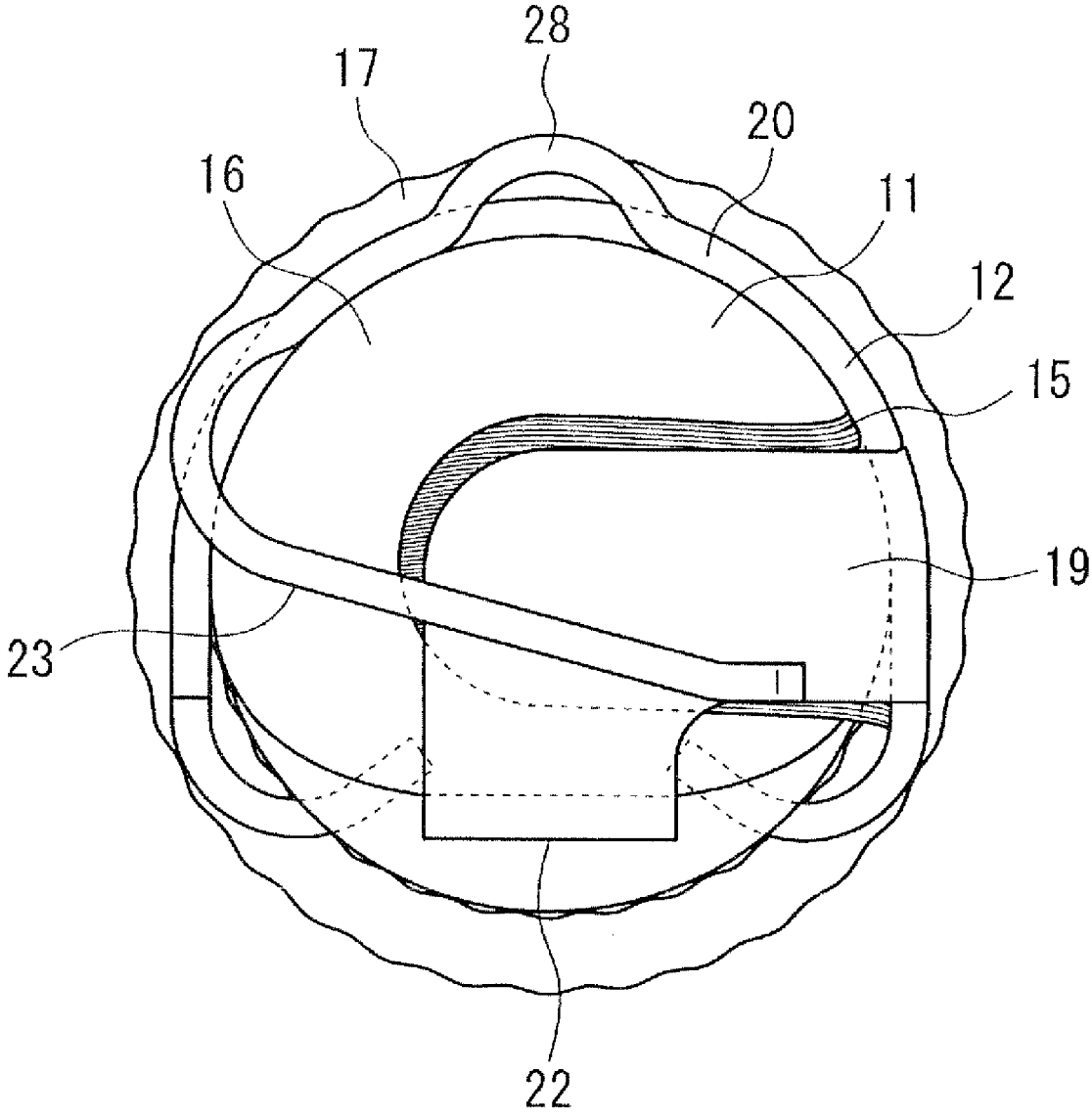
FIG. 6 is a front view showing the end of the cable body in FIG. 3.

FIG. 1 shows a cross-sectional view showing a primary portion of a tension cable 10 (cable) according to the exemplary embodiment of the invention. FIG. 2 is a lateral view showing an end of a cable body 11 having been stripped. FIG. 3 is a lateral view showing the end of the cable body 11 having been crimped with a cable terminal 12. FIGS. 4 to 6 are respectively a top view, a bottom view and a front view, each of which shows the end of the cable body in FIG. 3.

The tension cable 10 includes: a cable body 11; a cable terminal 12 mounted on a first end of the cable body 11; a plug cap 13 for covering the entirety of the cable terminal 12 together with the first end of the cable body 11; and a plug cover 14 for externally covering the plug cap 13. The tension cable 10 is connected to an ignition plug 90 at the first end while being connected to an ignition coil, a suitable voltage-applying device or the like (not shown) at its second end.

In this exemplary embodiment, the cable body 11 includes a core 15 formed of plural carbon fibers as shown in FIG. 2. With this arrangement, the cable body exhibits a greater electrical resistance than a typical cable having a metal core formed of, for example, copper wires. The cable body 11, which exhibits a greater electrical resistance as described above, can control electric noises generated when a high voltage is applied thereon, and reduce electric-wave disturbance brought to other electronic devices. In addition, insulation coating 16 of the cable body 11 is externally covered with braided shield 17 made of a metal conductor. With this arrangement, generated noises can be more reliably prevented from leaking to the outside. In order to prevent the metal conductor from coming apart, a terminal end of the braided shield 17 is covered with a suitable resin such as hot melt.

The cable terminal 12, which is exemplarily made of conductive stainless, is crimped and fixed to the insulation coating 16 of the cable body 11 by use of a predetermined crimping tool or the like. More specifically, the cable terminal 12 includes: a crimped portion 18 press-attached to the insulation coating 16 by crimping; a conductor contacting piece 19 provided integrally with the crimped portion 18 so as to face an end face of the cable body 11; and an extending piece 20 also provided integrally with the crimped portion 18 and extended forward in an insertion direction in which the cable body 11 is inserted (i.e., a direction coinciding with the axis direction of the cable body 11).

The crimped portion 18 is provided with a serrated cut-in portion 21 that is crimped by a crimping tool to slightly cut into the insulation coating 16. The cut-in portion 21 reliably fixes the crimped portion 18 to the insulation coating 16 after the crimped portion 18 is press-attached thereto.

The conductor contacting piece 19 is formed by bending the crimped portion 18 toward the center of the cable body 11. An end of the conductor contacting piece 19 is provided with a locking piece 22 formed by bending the conductor contacting piece 19 backward in the axis direction of the cable body 11. The locking piece 22 locks an outer end periphery of the insulation coating 16 at a position radially opposite to where the extending piece 20 is provided.

A face of the conductor contacting piece 19 that faces the end face of the cable body 11 is in contact with the core 15 having been exposed by stripping the insulation coating 16 around the first end of the cable body 11. The core 15 is bent along the conductor contacting piece 19 and sandwiched between the crimped portion 18 and the insulation coating 16. In this manner, by pressing the core 15 having been exposed at the first end of the cable body 11 to substantially the entirety of the planar portion of the conductor contacting piece 19, a favorable contact can be established between the core 15 and the conductor contacting piece 19, thereby establishing a reliable conduction between the core 15 and the cable terminal 12. In addition, the conductor contacting piece 19 is in abutment with a first contact 92 formed on an outer circumference of a plug terminal 91 of the ignition plug 90. With this arrangement, the first contact 92 and the core 15 sandwiches the conductor contacting piece 19 to establish a conduction with each other.

On the other hand, the extending piece 20 is integrally provided with a press piece 23 at a position spaced apart by a predetermined distance from the end face of the cable body 11. The press piece 23 projects to the plug terminal 91 in a cantilevered manner, and a bent portion provided on a first end of the press piece 23 contacts a second contact 93 formed on an end face of the plug terminal 91. The press piece 23, which is a springy member, is elastically deformed to reliably contact the second contact 93 while applying a predetermined pressing force thereto. Due to the contact of the press piece 23 with the conductor contacting piece 19, the plug 91 can be in conduction with the cable body 11 in two directions perpendicular to each other: namely, a first insertion direction in which the ignition plug 90 is inserted: and a second insertion direction (a direction perpendicular to the first insertion direction) in which the cable body 11 is inserted.

The plug cap 13, which is an elastic body exemplarily made of synthetic resin (rubber), is an important component in relation to the cable terminal 12. The plug cap 13, which is an L-shaped member, is provided with a cable-insertion hole 24 at its first end, into which the cable body 11 crimped with the cable terminal 12 is inserted. A second end of the plug cap 13 is provided with a plug-insertion hole 25 into which the ignition plug 90 is inserted. The insertion holes 24, 25 are internally communicated with each other.

As shown in FIG. 1, an inner opposing surface of the plug cap 13 that faces the opening portion of the cable-insertion hole 24 provides an abutment portion 26 on which a first end of the extending piece 20 of the cable terminal 12 abuts. Since the entirety of the plug cap 13 is elastic, the extending portion 20 is slightly buried in the abutment portion 26, thereby positioning the cable terminal 12 thereto in terms of the insertion direction.

A clearance defined by the opposing surface and the conductor contacting piece 19 when the cable terminal 12 is inserted thereinto is slightly smaller than an outer diameter of the plug terminal 91 on which the first and second contacts 92, 93 are provided. With a suitable tightening margin being provided by the clearance, the plug terminal 91 is located in the clearance. With this arrangement, the plug terminal 91 having been located in the clearance is in tight contact with the inner surface of the plug cap 13. In addition, applied with a pressing force generated by the elastic deformation of the inner surface of the plug cap 13, the plug terminal 91 is pressed to the conductor contacting piece 19. Thus, the first contact 92 is reliably brought partially into contact with the conductor contacting piece 19.

An inner diameter of the cable-insertion hole 24 is also set at such a value that can provide a tightening margin sufficient for the outer diameter of the cable body 11. The cable body 11 having been inserted in the cable-insertion hole 24 is applied with a pressing force generated by elastic deformation of an inner surface of the cable-insertion hole 24. With this arrangement, even when the plug terminal 91 located in the above-described clearance applies a force on the cable body 11 in a direction in which the cable body is disengaged from the cable-insertion hole 24, the cable body 11 can sufficiently resist the force applied by the plug terminal 91, whereby the contact of the plug terminal 91 with the conductor contacting piece 19 is favorably maintained.

A top portion of the plug-insertion hole 25 shown in FIG. 1 (i.e., a portion in the vicinity where the plug-insertion hole 25 is communicated with the cable-insertion hole 24) internally and circumferentially projects toward the inside, thereby defining a projection 27 having an arc cross section. The projection 27 is fitted into a recess 94 provided adjacent to a bottom of the plug terminal 91, thereby suitably establishing a concave-convex fitting. Elastic deformation of the projection 27 allows the plug terminal 91 to be inserted thereinto beyond the projection 27, so that the projection 27 is fitted into the recess 94. With this arrangement, the plug terminal 91 is stably positioned within the plug cap 13. The recess 94 is equivalent to the constricted portion having been described in the description of the background art. The recess 94 used in the ignition plug 90 according to this exemplary embodiment has a greater constriction than an ordinary constricted portion. Thus, it is difficult to apply a conventional connector spring to the above-arranged ignition plug 90.

While the projection 27 and the recess 94 are in a concave-convex fitting, the second contact 93 of the plug terminal 91 is in abutment with the press piece 23 of the cable terminal 12 and applied with a pressing force generated by elastic deformation of the press piece 23. Even when the plug terminal 94 is applied with the above pressing force, the concave-convex fitting prevents the plug terminal 91 from being returned by the pressing force. In addition, the extending piece 20 can be prevented from being warped by a reaction force from the plug terminal 91 because: the extending piece 20 is curved to be rigid and firm as shown in FIG. 6; the extending piece 20 is provided with a rib 28 for positioning the plug cap 13 and the cable terminal 12 when the plug cap 13 and the cable terminal 12 are assembled and for reinforcing the extending piece 20 as shown in FIG. 6; and substantially the entirety of the extending piece 20 abuts on an inner opposing surface of the cable-insertion hole 24. Accordingly, the contact of the second contact 93 with the press piece 23 is favorably maintained.

The plug-insertion hole 25 of the plug cap 13 also provides a tightening margin sufficient for an inserted portion 95 of the ignition plug 90. With this arrangement, the plug cap 13 can be stably held on the inserted portion 95 of the ignition plug 90 via the plug-insertion hole 25 capable of covering a larger area, thereby preventing easy disengagement of the plug cap 13 from the ignition plug 90. In addition, the concave-convex fitting portion and the vicinity of the plug terminal 91 are not required to provide a holding force, which also contributes to favorable maintenance of the contact between the plug terminal 91 and the cable terminal 12.

Additionally, a plug cover 14 included in the tension cable 10 according to this exemplary embodiment is made of metal so as not to let electric noises generated within the plug cap 13 leak to the outside thereof. As shown in FIG. 1, the plug cover 14 includes two dividable halves respectively adapted to be opened and closed about a hinge 29 provided on a top portion of the plug cover 14. Plural engaging portions 30 provided on an outer circumference of a second half of the plug cover 14 are engaged with a collar-shaped periphery provided along an outer circumference of a first half of the plug cover 14 (FIG. 1 only shows the first half of the plug cover 14 and the engaging portions 30 provided on the second half of the plug cover 14). By engaging the engaging portions 30 therewith, the two halves are closed, so that the entirety of the plug cap 13 is housed within the plug cover 14.

Further, a recessed groove 31 is provided in the vicinity of the opening portion of the plug cover 14 adjacent to the ignition plug 90, into which a holding ring 32 formed of spring material is fitted. The holding ring 32 forcibly connects the two halves of the plug cover 14, and maintains a favorable fitting of the plug cap 13 with the ignition plug 90. The vicinity of the opening portion of the plug cover 14 adjacent to the cable body 11 is closed by a member such as a shrink tube 33 that bridges the plug cover 14 and the cable body 11.

It should be noted that, although the best structure, method and the like for implementing the invention have been described in the above description, the invention is not limited to the above description. Specifically, while the invention has been described above with a specific embodiment(s) being particularly illustrated and mainly described, those skilled in the art may make various modifications to the above-described embodiments in terms of a shape, quantity or any other detailed configuration without departing from a scope of a technical idea and an object of the invention.

Thus, a shape, quantity and the like described above merely serve as exemplifying the invention for facilitating an understanding of the invention, and do not serve as any limitations on the invention, so that what is described by a name of a component for which the description of the shape, quantity and the like are partially or totally omitted is also included in the invention.

The invention claimed is:

1. A cable terminal inserted into a plug cap for an ignition plug while being crimped to a cable body, the cable terminal comprising:

a crimped portion crimped to the cable body;

an extending piece provided integrally with the crimped portion to extend forward in an insertion direction; and a conductor contacting piece provided integrally with the crimped portion to face an end face of the cable body, wherein an end of the extending piece abuts on an inner surface of the plug cap to determine a position in terms of the insertion direction, the plug cap being made of an elastic body, the extending piece is provided with a springy press piece that projects to a plug terminal of the ignition plug inserted into the plug cap and contacts an end face of the plug terminal, and the conductor contacting piece is sandwiched between a portion of an outer circumference of the plug terminal and a core exposed from the end face of the cable body, the plug terminal disposed to be in tight contact with the inner surface of the plug cap.

2. A cable, comprising:

the cable terminal according to claim 1;

the cable body to which the cable terminal is crimped; and the plug cap into which the cable terminal having been crimped to the cable body and the ignition plug are inserted, the cable terminal being inserted from a first end side of the plug cap, the ignition plug being inserted from a second end side of the plug cap.

3. The cable according to claim 2, wherein a plug-insertion hole of the plug cap is provided with a projection that inwardly projects, and the projection is fitted into a recess provided adjacent to the plug terminal of the ignition plug in a concave-convex manner.

* * * * *